US011746771B2

(12) United States Patent
DCunha

(10) Patent No.: US 11,746,771 B2
(45) Date of Patent: Sep. 5, 2023

(54) ACTUATOR VALVE OF AN AIR OPERATED DOUBLE DIAPHRAGM PUMP

(71) Applicant: Teryair Equipment Pvt. Ltd., Palghar (IN)

(72) Inventor: Terence Valentine DCunha, Mumbai (IN)

( * ) Notice: Subject to any disclaimer, the term of this patent is extended or adjusted under 35 U.S.C. 154(b) by 197 days.

(21) Appl. No.: 17/348,415

(22) Filed: Jun. 15, 2021

(65) Prior Publication Data

US 2022/0333592 A1 Oct. 20, 2022

(51) Int. Cl.
*F04B 43/073* (2006.01)
*F01L 25/06* (2006.01)

(52) U.S. Cl.
CPC ..... *F04B 43/0736* (2013.01); *F01L 25/063* (2013.01)

(58) Field of Classification Search
None
See application file for complete search history.

(56) References Cited

U.S. PATENT DOCUMENTS 3,304,126 A * 2/1967 Rupp ..... B65G 53/66 406/96
3,348,803 A * 10/1967 Churchill, Jr. ..... F01L 25/063 251/12
3,465,686 A * 9/1969 Nugier ..... F04B 9/133 417/403
4,242,941 A * 1/1981 Wilden ..... F01L 25/06 91/329
4,543,977 A * 10/1985 Arav ..... G05D 16/028 92/85 B
4,549,467 A * 10/1985 Wilden ..... F01L 5/04 91/320
4,854,832 A * 8/1989 Gardner ..... F04B 43/0736 417/393
5,174,731 A * 12/1992 Korver ..... F16K 11/0704 417/393
5,222,876 A * 6/1993 Budde ..... F01L 25/08 417/393
5,232,352 A * 8/1993 Robinson ..... F04B 43/0736 417/393
5,261,798 A * 11/1993 Budde ..... F04B 9/135 417/393
5,375,625 A * 12/1994 Reynolds ..... F16K 35/04 251/297

(Continued)

*Primary Examiner* — Bryan M Lettman
*Assistant Examiner* — Geoffrey S Lee
(74) *Attorney, Agent, or Firm* — AU LLC; Adam E. Urbanczyk

(57) ABSTRACT

The invention relates to an actuator valve 136 of an air operated double diaphragm pump 100. The actuator valve 136 includes a valve housing 138, an inlet 142 for receiving air, a first set of ports 144*a*,144*b* for exchanging the air with air chambers 132*a*,132*b*, and a second set of ports 146*a*, 146*b* for exhausting the air received from the air chambers 132*a*,132*b* into the atmosphere. The actuator valve 136 further includes a valve piston 148 accommodated within the valve housing 138. The valve piston 148 is configured to reciprocally slide within the valve housing 138 and has a bore 152 at one end. The actuator valve 136 further includes an end plate 156*a*,156*b* at each end of the valve housing 138, and has a boss 158 at the corresponding end. The boss 158 and the bore 152 are arranged such that the boss 158 mates with the bore 152.

7 Claims, 7 Drawing Sheets

(56) References Cited

U.S. PATENT DOCUMENTS 5,377,719 A * 1/1995 Gyllinder ..... F01L 25/063 251/47
5,391,060 A * 2/1995 Kozumplik, Jr. ... F04B 43/0736 417/393
5,435,336 A * 7/1995 Serot ..... F16K 39/022 137/554
5,558,506 A * 9/1996 Simmons ..... F01L 25/066 417/393
5,611,678 A * 3/1997 Pascual ..... F01L 25/066 417/393
5,893,707 A * 4/1999 Simmons ..... F04B 9/135 417/393
6,004,105 A * 12/1999 Reynolds ..... F04B 43/0736 417/387
6,036,445 A * 3/2000 Reynolds ..... F04B 43/0736 417/395
6,071,090 A * 6/2000 Miki ..... F04B 43/0736 417/454
6,079,959 A * 6/2000 Kingsford ..... F04B 53/164 417/393
6,102,363 A * 8/2000 Eberwein ..... F16K 3/26 251/63
6,474,961 B1 * 11/2002 Timmer ..... F04B 43/0736 417/393
6,722,256 B2 * 4/2004 Roberts ..... F04B 53/08 91/286
7,637,281 B2 * 12/2009 Rapke ..... F16K 31/426 251/65
8,622,720 B2 * 1/2014 Simmons ..... F04B 17/044 417/472
9,003,950 B2 * 4/2015 Headley ..... F04B 9/1256 91/281
2003/0198560 A1 * 10/2003 Able ..... F04B 43/0736 417/393
2005/0249612 A1 * 11/2005 Distaso ..... F04B 43/0736 417/384
2005/0281688 A1 * 12/2005 Towne ..... F04B 43/0733 417/440
2010/0043895 A1 * 2/2010 Towne ..... F15B 21/12 417/279

* cited by examiner

ACTUATOR VALVE OF AN AIR OPERATED DOUBLE DIAPHRAGM PUMP

TECHNICAL FIELD

The present invention generally relates to an air operated double diaphragm pump, and more particularly, the present invention relates to an actuator valve of the air operated double diaphragm pump. The present invention discloses an actuator valve that prevents stalling of the valve piston, thereby preventing the stalling of the air operated double diaphragm pump.

BACKGROUND

Air operated double diaphragm pump (AODD pump) is quite commonly known in the art. The air operated double diaphragm pump includes an actuator valve which employs a pneumatically controlled valve piston. The valve piston is configured to control the incoming flow of pressurized air to provide an alternating flow to a reciprocating central shaft of the air operated double diaphragm pump. This alternating flow forces the central shaft to stroke back and forth thereby performing useful work. Thus, such actuator valves convert a relatively steady source of pressurized air into an alternating flow without need for any outside timing or control system. The source air pressure alone drives the actuator valve as well as the working device.

However, one of the shortcomings of the conventional actuator valve is the effect of stalling. Stalling occurs when the valve piston reaches a central position in its travel path, and the forces on either end of the valve piston become same. The stalling can occur at any unpredictable time. Moreover, during a stalled condition, the pressurized air which is received via an external source, continues to flow through the air operated double diaphragm pump and out via an exhaust. When a pump fitted with such an actuator valve is stalled, the pumping process is stopped which eventually leads to downtime. To restart the stalled actuator valve, the valve piston has to be manually dislodged from its central position which consumes both effort and time.

Therefore, in light of the discussion above, there is a need for a novel and improved actuator valve of an air operated double diaphragm pump that does not suffer from above mentioned limitations.

OBJECT OF THE INVENTION

An object of the present invention is to provide a novel actuator valve of an air operated double diaphragm pump.

Another object of the present invention is to provide an actuator valve of an air operated double diaphragm pump that prevents stalling of a valve piston in the actuator valve.

Another object of the present invention is to provide an actuator valve that is simpler in construction and less expensive to manufacture.

Another object of the present invention is to provide an air operated double diaphragm pump with the novel actuator valve.

SUMMARY OF THE INVENTION

According to an exemplary embodiment of the present invention, an actuator valve of an air operated double diaphragm pump is disclosed. The actuator valve includes a valve housing. The actuator valve further includes an inlet for receiving air from an external source. The actuator valve further includes a first set of ports for exchanging the air with each of the air chambers of the air operated double diaphragm pump. The actuator valve further includes a second set of ports for exhausting the air received from each of the air chambers of the air operated double diaphragm pump into the atmosphere. The actuator valve further includes a valve piston accommodated within the valve housing. The valve piston is configured to reciprocally slide within the valve housing. The valve piston has a bore at one end. The actuator valve further includes an end plate arranged at each end of the valve housing for limiting the movement of the valve piston. The end plate has a boss at the corresponding end where the valve piston has the bore. The boss of the end plate and the bore of the valve piston are arranged in such a manner that the boss mates with the bore.

According to another exemplary embodiment of the present invention, an air operated double diaphragm pump is disclosed. The air operated double diaphragm pump includes an inlet manifold having an inlet port. The inlet manifold is configured to receive a fluid from the inlet port. The double diaphragm pump further includes an outlet manifold having an outlet port. The outlet manifold is configured to exhaust the fluid out from the outlet port. The double diaphragm pump further includes two chambers, and a central shaft disposed between the two chambers. The central shaft is configured to reciprocate between the two chambers. The double diaphragm pump further includes a diaphragm attached at each end of the central shaft. The diaphragm at each end is configured to divide the respective chamber into an air chamber and a fluid chamber. The double diaphragm pump further includes an actuator valve. The actuator valve includes a valve housing. The actuator valve further includes an inlet for receiving air from an external source. The actuator valve further includes a first set of ports for exchanging the air with each of the air chambers of the air operated double diaphragm pump. The actuator valve further includes a second set of ports for exhausting the air received from each of the air chambers of the air operated double diaphragm pump into the atmosphere. The actuator valve further includes a valve piston accommodated within the valve housing. The valve piston is configured to reciprocally slide within the valve housing. The valve piston has a bore at one end. The actuator valve further includes an end plate arranged at each end of the valve housing for limiting the movement of the valve piston. The end plate has a boss at the corresponding end where the valve piston has the bore. The boss of the end plate and the bore of the valve piston are arranged in such a manner that the boss mates with the bore.

It is to be understood that both the foregoing general description and the following detailed description are exemplary and explanatory only and are not restrictive of the invention, as claimed.

BRIEF DESCRIPTION OF THE ACCOMPANYING DRAWINGS

So that the manner in which the above recited features of the present invention can be understood in detail, a more particular description of the invention, briefly summarized above, may have been referred by embodiments, some of which are illustrated in the appended drawings. It is to be noted, however, that the appended drawings illustrate only typical embodiments of this invention and are therefore not to be considered limiting of its scope, for the invention may admit to other equally effective embodiments.

These and other features, benefits, and advantages of the present invention will become apparent by reference to the following figures, with like reference numbers referring to like structures across the views, wherein.

Figure 5:
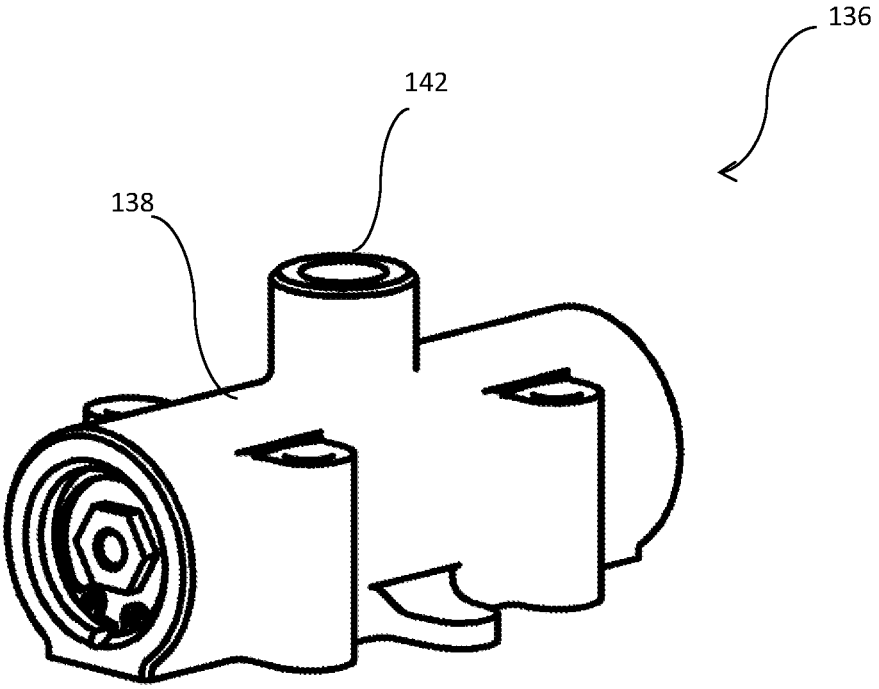
Figure 6:
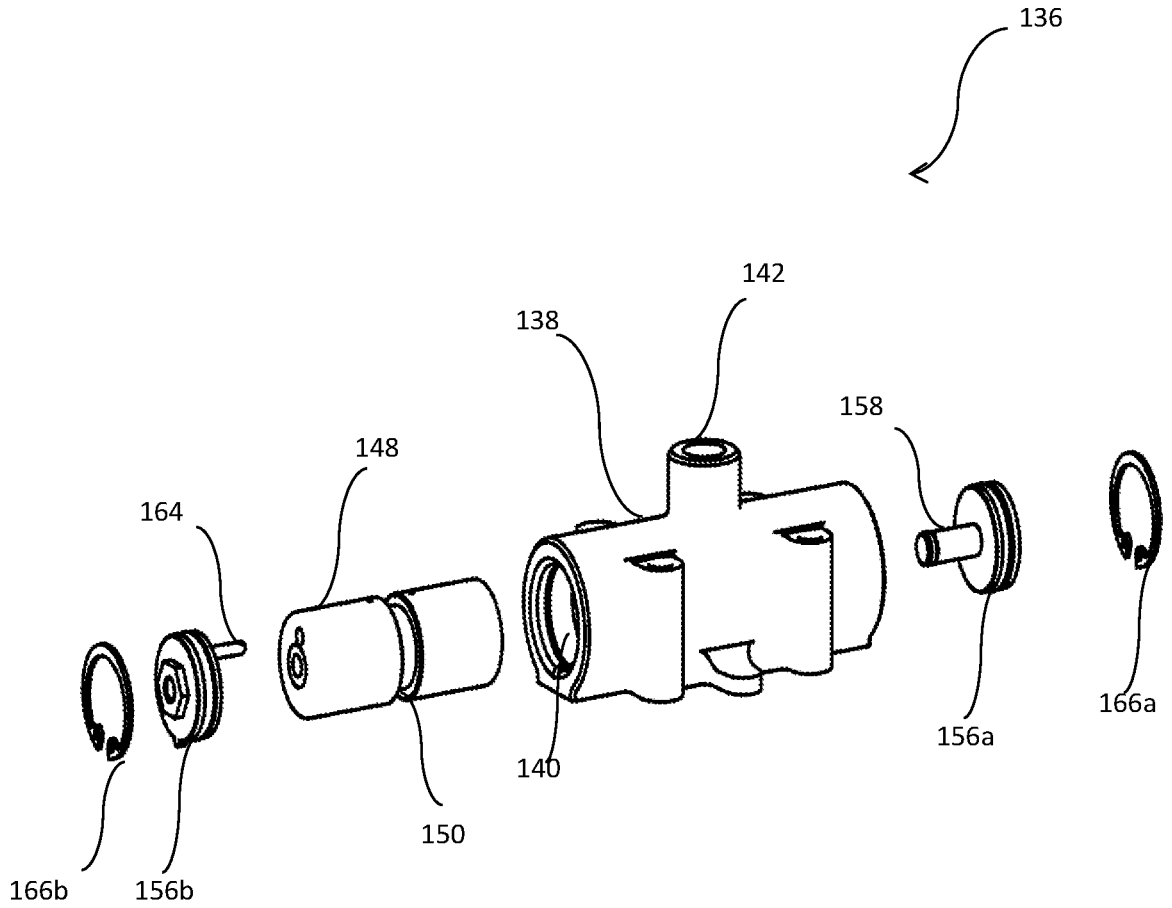
Figure 7:
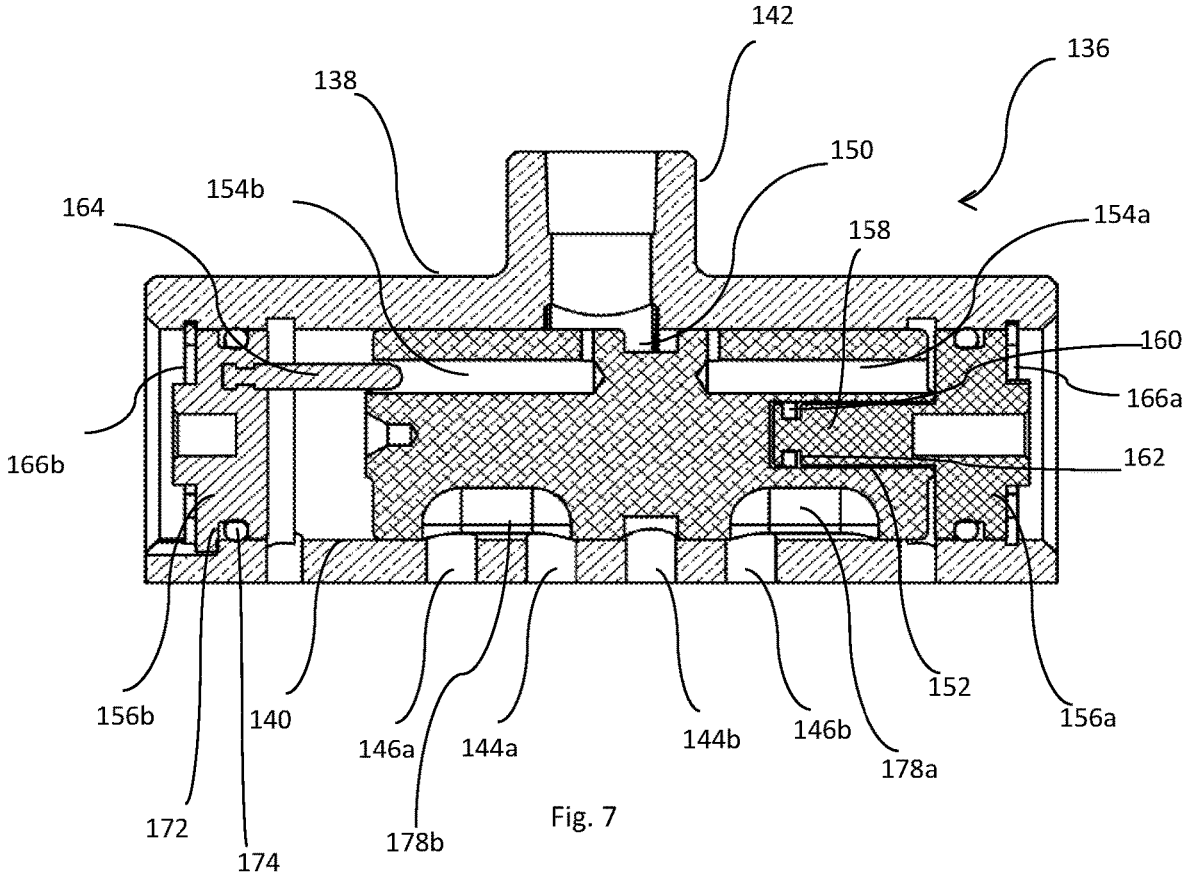
Figure 8:
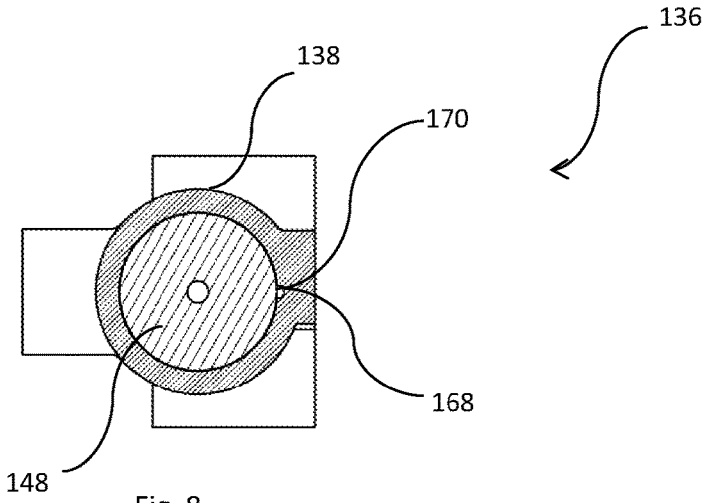

FIG. 5 illustrated a perspective view of an actuator valve, in accordance with another exemplary embodiment of the invention;

FIG. 6 illustrates an exploded view of the actuator valve, in accordance with an exemplary embodiment of the invention;

FIG. 7 illustrates a cross-sectional view of the actuator valve, in accordance with an exemplary embodiment of the present invention; and FIG. 8 illustrates a side view of the actuator valve in accordance with an exemplary embodiment of the invention.

DETAILED DESCRIPTION OF THE PREFERRED EMBODIMENTS

While the present invention is described herein by way of example using embodiments and illustrative drawings, those skilled in the art will recognize that the invention is not limited to the embodiments of drawing or drawings described, and are not intended to represent the scale of the various components. Further, some components that may form a part of the invention may not be illustrated in certain figures, for ease of illustration, and such omissions do not limit the embodiments outlined in any way. It should be understood that the drawings and detailed description thereto are not intended to limit the invention to the particular form disclosed, but on the contrary, the invention is to cover all modifications, equivalents, and alternatives falling within the scope of the present invention as defined by the appended claim. As used throughout this description, the word "may" is used in a permissive sense (i.e. meaning having the potential to), rather than the mandatory sense, (i.e. meaning must). Further, the words "a" or "an" mean "at least one" and the word "plurality" means "one or more" unless otherwise mentioned. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes. Any discussion of documents, acts, materials, devices, articles and the like is included in the specification solely for the purpose of providing a context for the present invention. It is not suggested or represented that any or all of these matters form part of the prior art base or were common general knowledge in the field relevant to the present invention.

In this disclosure, whenever a composition or an element or a group of elements is preceded with the transitional phrase "comprising", it is understood that we also contemplate the same composition, element or group of elements with transitional phrases "consisting of", "consisting", "selected from the group of consisting of, "including", or "is" preceding the recitation of the composition, element or group of elements and vice versa.

The present invention is described hereinafter by various embodiments with reference to the accompanying drawings, wherein reference numerals used in the accompanying drawings correspond to the like elements throughout the description. This invention may, however, be embodied in many different forms and should not be construed as limited to the embodiment set forth herein. Rather, the embodiment is provided so that this disclosure will be thorough and complete and will fully convey the scope of the invention to those skilled in the art.

Figure 1:
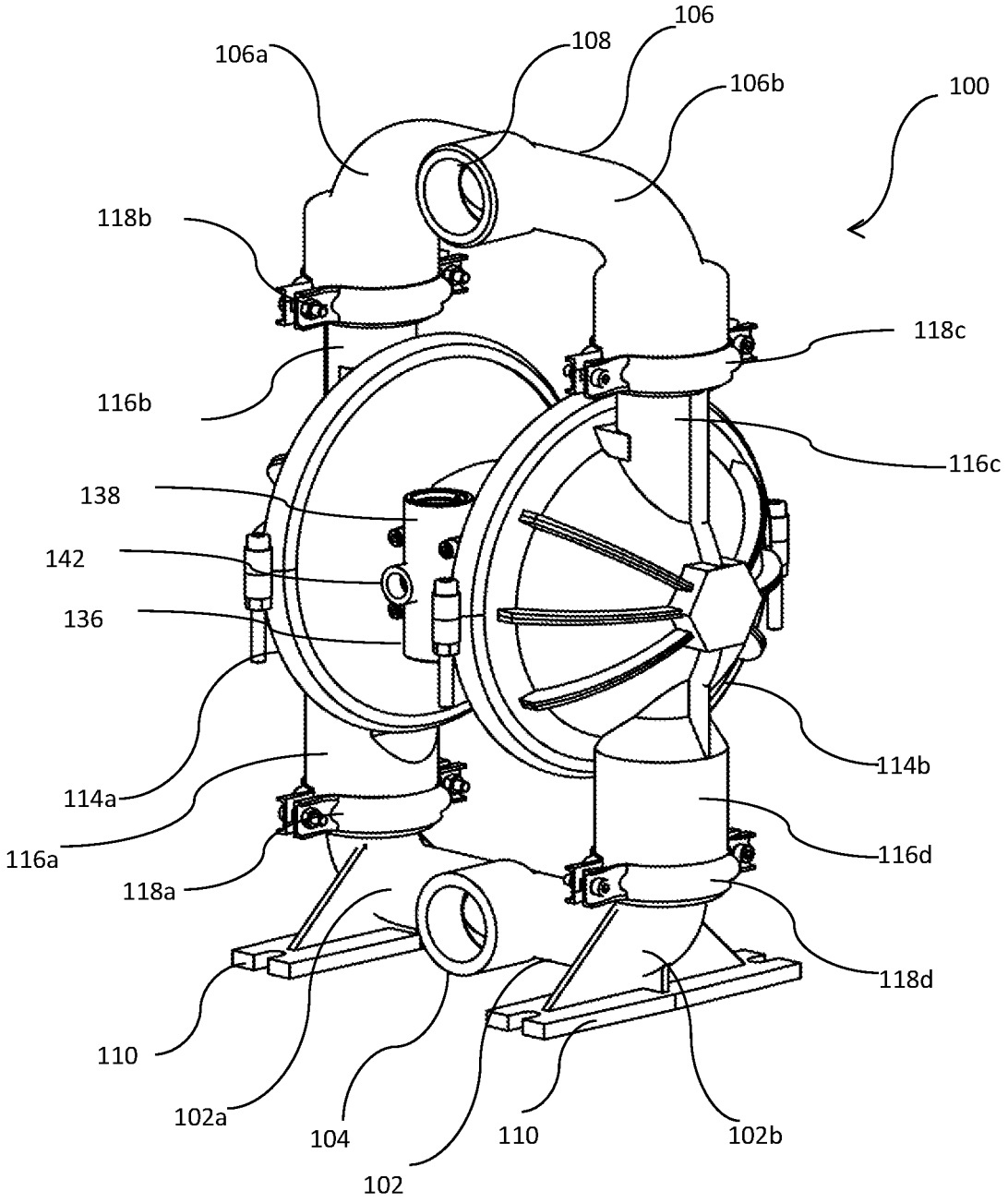
FIG. 1 illustrates a perspective view of an air operated double diaphragm pump, in accordance with an exemplary embodiment of the present invention.

Referring now to FIG. 1, a perspective view of an air operated double diaphragm pump 100 is illustrated, in accordance with an exemplary embodiment of the present invention. The air operated double diaphragm pump (hereinafter referred to as 'AODD pump') 100 may be a positive displacement pump. The AODD pump 100 may use compressed air as the power source for driving the AODD pump 100. Further, the AODD pump 100 may be employed in various industries such as, but not limited to, petrochemical industries, food industries, beverage industries etc.

The AODD pump 100 may include an inlet manifold 102 as shown in the FIG. 1. The inlet manifold 102 may include two inlet passageways 102*a*, 102*b*. In other words, the inlet passageways 102*a*, 102*b* may be collectively called as the inlet manifold 102. The inlet manifold 102 may further include an inlet port 104 which may be connected to a fluid source. It will be apparent to a person skilled in the art that the type of fluid received from the fluid source will vary according to the application where the AODD pump 100 is employed. The fluid may be received in the inlet manifold 102 via the inlet port 104. As per the construction and working of the AODD pump 100 which is described in detail in the specification, the fluid received via the inlet port 104 may alternately pass through the each inlet passageways 102*a*, 102*b*.

The AODD pump 100 may further include an outlet manifold 106. The outlet manifold 106 may include two outlet passageways 106*a*, 106*b*. In other words, the outlet passageways 106*a*, 106*b* may be collectively called as the outlet manifold 106. The outlet manifold 106 may further include an outlet port 108 which is provided to exhaust the fluid from the AODD pump 100. Similar to the working of the inlet port 104 and the inlet passageways 102*a*, 102*b*, the outlet port 108 may exhaust the fluid alternately from each outlet passageways 106*a*, 106*b*. In a preferred embodiment, the inlet manifold 102 may be positioned at the bottom section of the AODD pump 100, and the outlet manifold 106 may be positioned at the top section of the AODD pump 100 as shown in the FIG. 1. In certain embodiments, the AODD pump 100 may further include at least one support stand 110 to assist the AODD pump 100 to stand in an upright position. A person skilled in the art will appreciate that the shape and size of the support stand 110 may not be limited as shown in the FIG. 1, and the support stand 110 of other shapes and sizes may also be implemented.

Figure 2:
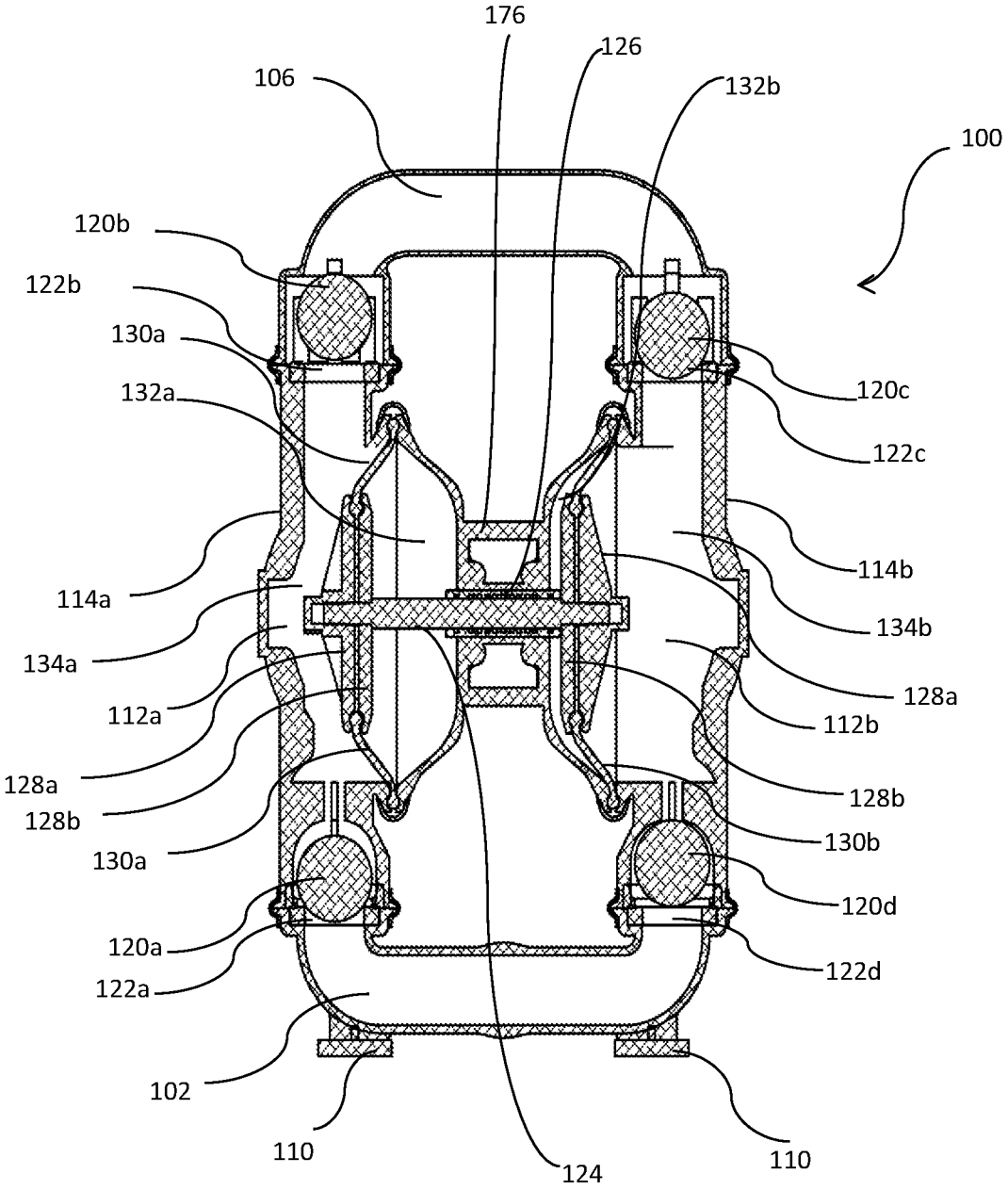
FIG. 2 illustrates a front cross-sectional view of the air operated double diaphragm pump of FIG. 1, in accordance with an exemplary embodiment of the present invention.
Figure 3:
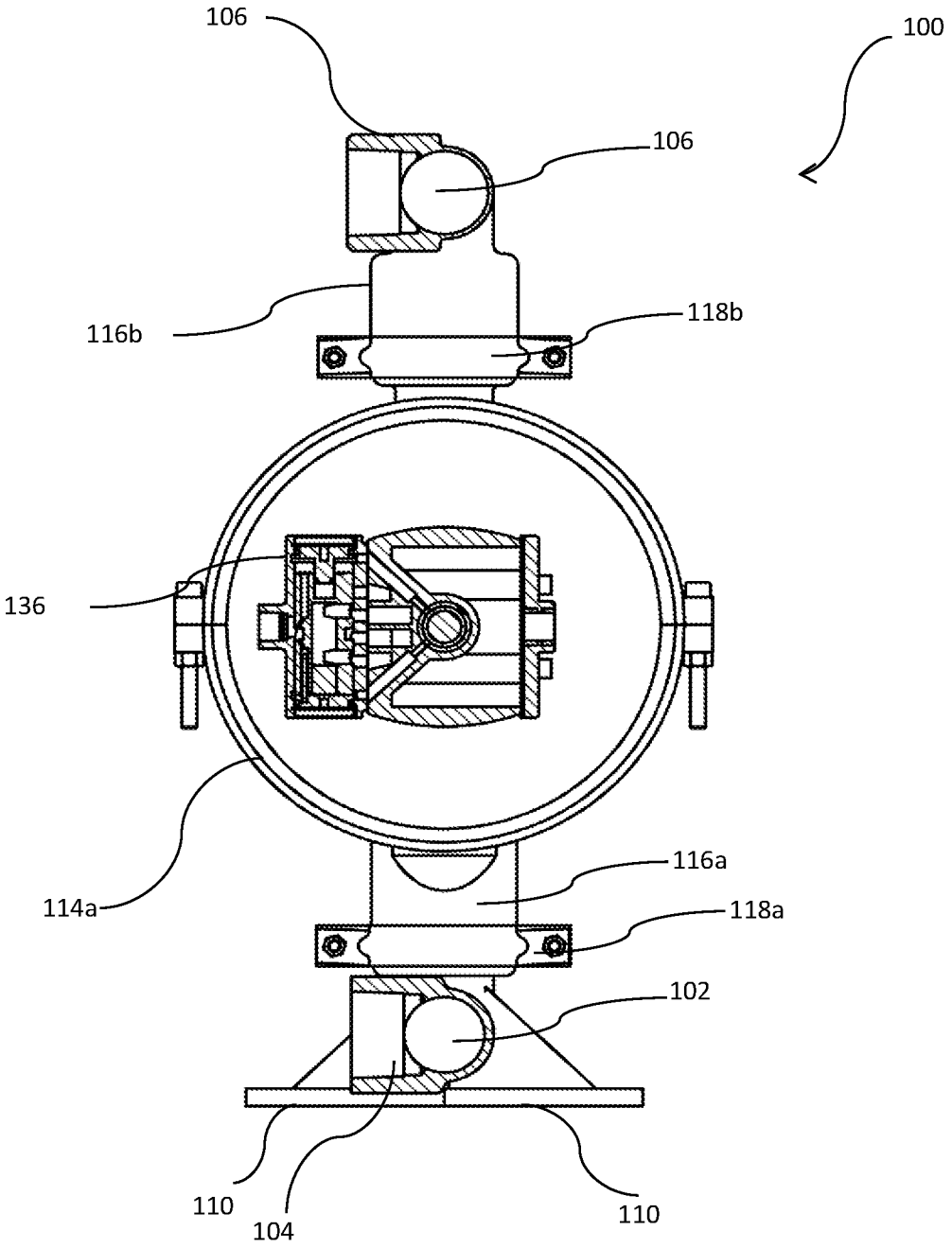
FIG. 3 illustrates a side cross-sectional view of the air operated double diaphragm pump of FIG. 1, in accordance with an exemplary embodiment of the present invention.
Figure 4:
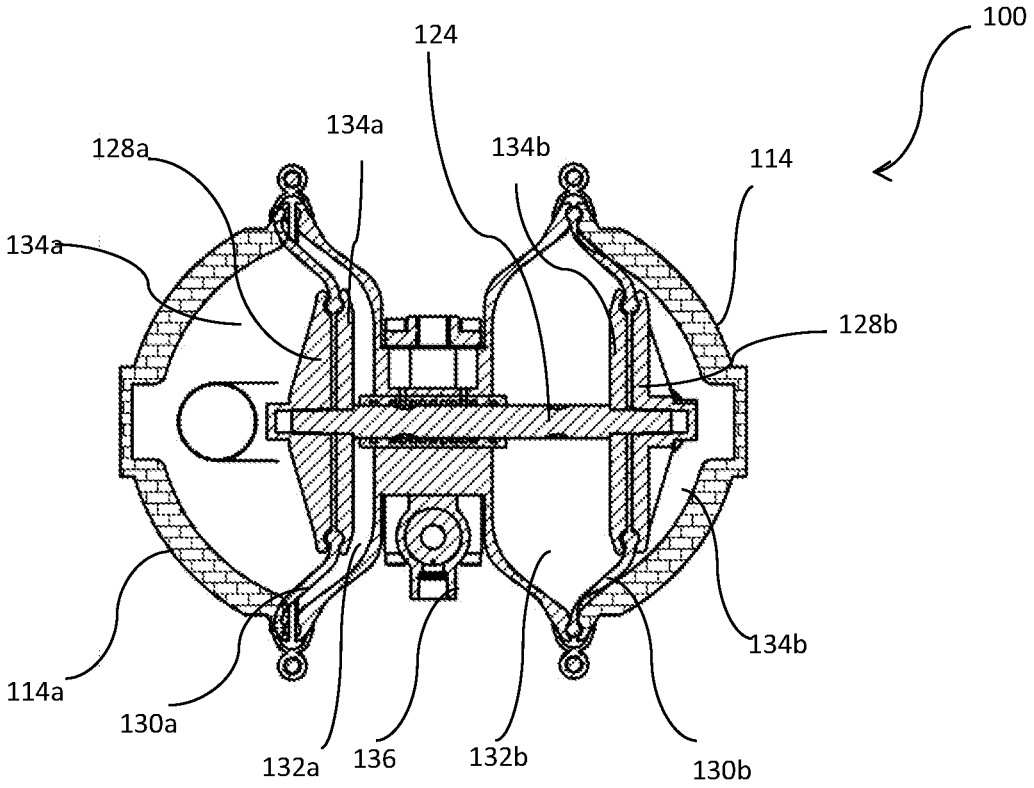
FIG. 4 illustrates a top cross-sectional view of the air operated double diaphragm pump of FIG. 1, in accordance with an exemplary embodiment of the present invention.

Referring now to FIG. 2, FIG. 3 and FIG. 4, a front cross-sectional view, a side cross-sectional view and a top cross-sectional view respectively of the AODD pump 100 is illustrated, in accordance with an exemplary embodiment of the present invention. As shown in FIG. 2, the AODD pump 100 may further include two chambers 112*a*, 112*b*. Each of the two chambers 112*a*, 112*b* may be enclosed by a respective casing 114*a*, 114*b* as shown in FIG. 1. For the purpose of illustration, the casing 114*a* may be identical in shape and size to the casing 114*b*. Moreover, the casing 114*a* may be arranged symmetrical to the casing 114*b* in the AODD pump 100. Further the casing 114*a* may be connected to the casing 114*b* via a shaft housing 176. In certain embodiments, the shaft housing 176 may form the part of the casing 114*a*, 114*b* itself.

The casings 114*a*, 114*b* may be arranged between the inlet manifold 102 and the outlet manifold 104. Each of the casings 114*a*, 114*b* may further have tubular extensions 116*a*, 116*b*, 116*c*, 116*d* to connect to the respective ends of the inlet manifold 102 and the outlet manifold 106. In order to further elaborate the arrangement, the casing 114*a* may be connected to the inlet passageway 102*a* via the tubular extension 116*a*, and the casing 114*a* may be connected to the outlet passageway 106*a* via the tubular extension 116*b*. Similarly, the casing 114*b* may be connected to the inlet passageway 102*b* via the tubular extension 116*d*, and the casing 114*b* may be connected to the outlet passageway 106*b* via the tubular extension 116*c*. It will be apparent to a person skilled in the art that the casings 114*a*, 114*b* may be connected to the inlet manifold 102 and the outlet manifold 106 by any fastening means known in the art. In certain embodiments, the two casings 114*a*, 114*b* may be connected to the inlet manifold 102 and the outlet manifold 106 via clamp bands 118*a*, 118*b*, 118*c*, 118*d* as shown in FIG. 1.

Further, the AODD pump 100 may include a ball 120*a*, 120*b*, 120*c*, 120*d* between the chambers 112*a*, 112*b*, and the inlet passageways 102*a*, 102*b* and the outlet passageways 106*a*, 106*b*. Each of the balls 120*a*, 120*b*, 120*c*, 120*d* may be arranged to sit on a respective ball seat 122*a*, 122*b*, 122*c*, 122*d* provided between the chamber 112*a*, 112*b*, and the inlet passageways 102*a*, 102*b* and the outlet passageways 106*a*, 106*b*. The ball 120*a*, 120*b*, 120*c*, 120*d* and the ball seat 122*a*, 122*b*, 122*c*, 122*d* may act as non-return valve. For the purpose of explanation, the ball 120*a* positioned between the inlet passageway 102*a* and the chamber 112*a* may allow the fluid passing through the inlet passageway 102*a* to selectively enter the chamber 112*a*, and the ball 120*b* positioned between the chamber 112*a* and the outlet passageway 106*a* may allow the fluid to selectively enter the outlet passageway 106*a*. Similarly, the ball 120*d* positioned between the inlet passageway 102*b* and the chamber 112*b* may allow the fluid passing through the inlet passageway 102*b* to selectively enter the chamber 112*b*, and the ball 120*c* positioned between the chamber 112*b* and the outlet passageway 106*b* may allow the fluid to selectively enter the outlet passageway 106*b*. It should be noted here that both the chambers 112*a*, 112*b* may be divided into an air chamber and a fluid chamber which is explained in detail below. Therefore, the ball 120*a*, 120*b*, 120*c*, 120*d* and the ball seat 122*a*, 122*b*, 122*c*, 122*d* allow the fluid exchange to take place only with the fluid chambers.

The AODD pump 100 may further include a central shaft 124 disposed between the two chambers 112*a*, 112*b*. The central shaft 124 may be configured to reciprocate between the two chambers 112*a*, 112*b*. Moreover, the central shaft 124 may be configured to reciprocate in a bush 126 as shown in FIG. 2. The bush 126 may be arranged within the shaft housing 176. The central shaft 126 may have a plurality of indentations for air to flow. A pair of plates 128*a*, 128*b* may be attached at each end of the central shaft 124. The pair of plates 128*a*, 128*b* may include an outer collar 128*a* and an inner collar 128*b*. Further, a diaphragm 130*a*, 130*b* may be attached at each end of the central shaft 124. It will be apparent to a person skilled in the art that the diaphragm 130*a*, 130*b* may be a flexible member. The diaphragm 130*a*, 130*b* may be clamped between the respective outer collar 128*a* and the respective inner collar 128*b* and the casing 114*a*, 114*b*. It should be noted that the diaphragm 130*a*, 130*b* at each end of the central shaft 124 is configured to divide the respective chamber 112*a*, 112*b* into an air chamber 132*a*, 132*b* and a fluid chamber 134*a*, 134*b*. Each of the air chambers 132*a*, 132*b* may be configured to receive the compressed air via an actuator valve 136. Each of the fluid chambers 134*a*, 134*b* may be configured to receive fluid from the inlet manifold 102. The construction of the actuator valve 136 is further explained in detail in the specification.

Now, the working of the AODD pump 100 is described in detail herein. The compressed air may be received in each of the air chambers 132*a*, 132*b* via the actuator valve 136. The actuator valve 136 may selectively control the flow of the compressed air into both the air chambers 132*a*, 132*b*. For the purpose of explanation, the actuator valve 136 may allow the flow of air into each of the air chamber 132*a*, 132*b* in an alternate manner. In doing so, each of the air chambers 132*a*, 132*b* may get pressurized alternately. When the compressed air is delivered to air chamber 132*a*, the air chamber 132*a* may exert force on the diaphragm 130*a* which may move the central shaft 124 in the axial direction away from the air chamber 132*b*. This will also lead to the air chamber 132*b* to exhaust the air from the air chamber 132*b*. While the air chamber 132*a* is being filled with the compressed air, and the air chamber 132*b* is being exhausted as explained above, the central shaft 124 may move in an axial direction.

Moreover, when the air is getting filled in the air chamber 132*a*, the fluid in the fluid chamber 134*a* gets squeezed out of the fluid chamber 134*a* via the non-return ball 120*b* and ball seat 122*b* to the outlet passageway 106*a* of the AODD pump 100. It will be apparent to a person skilled in the art that the fluid within the fluid chamber 134*a* may not return to the inlet passageway 102*a* due to the presence of the non-return ball 120*a* and the ball seat 122*a* between the fluid chamber 134*a* and the inlet passageway 102*a*.

Simultaneously, when the fluid is being squeezed out of the fluid chamber 134*a*, the fluid will be also sucked into the fluid chamber 134*b* due to the vacuum being formed when the central shaft 124 moves axially away along with the diaphragm 130*b*. This vacuum may cause the fluid to be sucked into the fluid chamber 134*b* via the ball 120*d* and ball seal 122*d* from the inlet passageway 102*b*.

When central shaft 124 may reach the end of its stroke, the actuator valve 136 may reverse the air flow direction and now compressed air may be delivered to the air chamber 132*b*, and at the same time, the air in the air chamber 132*a* may start to get exhausted. This may move the central shaft 124 in the opposite direction and axially away from the air chamber 132*a*. During the movement of the central shaft 124 in the opposite direction, the fluid in the fluid chamber 134*b* may get squeezed out through the outlet passageway 106*b* via the non-return ball 120*c* and the ball seat 122*c*. At the same time, the fluid may be sucked into the fluid chamber 134*a* through the inlet passageway 102*a* via the non-return ball 120*a* and the ball seat 122*a*. During the end of the stroke, the flow of air may be again reversed and the cycle may continue.

Referring now to FIG. 5, FIG. 6 and FIG. 7, a perspective view, an exploded view and a front cross-sectional view respectively of the actuator valve 136 is illustrated, in accordance with an exemplary embodiment of the present invention. The actuator valve 136 may be arranged in a vertical position on the rear of the AODD pump 100. Further, the actuator valve 136 may be fastened to the AODD pump 100 via a plurality of bolts. The actuator valve 136 may include a valve housing 138 with a machined bore 140. The actuator valve 136 may further include an inlet 142 for receiving compressed air into the actuator housing 138. The inlet 142 may have internal threads for connecting an external air source to it. According to an embodiment, the external air source may be a compressor. The compressor may be connected to the inlet 142 via a conduit. When turned on, the compressor may continuously deliver the compressed air into the actuator housing 138 via the inlet 142. The compressed air received via the inlet 142 may be alternately delivered to each of the air chambers 132*a*, 132*b* to drive the central shaft 124 as explained above.

The actuator valve 136 may further include a first set of ports 144*a*, 144*b* for exchanging air with each of the air chambers 132*a*, 132*b*. The first set of ports 144*a*, 144*b* may include two ports 144*a*, 144*b* where each port 144*a*, 144*b* connects to a different air chamber 132*a*, 132*b* and exchanges air with the respective air chambers 132*a*, 132*b*. For the purpose of explanation, the port 144*a* may allow the air to flow between the air chamber 132*a* and the valve housing 138. Similarly, the port 144*b* may allow the air to flow between the air chamber 132*b*, and the valve housing 138.

The actuator valve 136 may further include a second set of ports 146*a*, 146*b* for exhausting the air received from each of the air chambers 132*a*, 132*b* into the atmosphere. The second set of ports 146*a*, 146*b* may include two ports 146*a*, 146*b* where each port 146*a*, 146*b* is provided to exhaust the air received from a different air chamber 132*a*, 132*b*. For the purpose of explanation, the port 146*a* may exhaust the air received from the air chamber 132*a*, and the port 146*b* may exhaust the air received from the air chamber 132*b*.

The actuator valve 136 may further include a valve piston 148 accommodated within the valve housing 138. Specifically, the valve piston 148 may be accommodated within the machined bore 140 of the valve housing 138. The valve piston 148 is configured to reciprocally slide within the valve housing 138. During the sliding movement of the valve piston 148, the valve piston 148 may control the opening and closing of the first set of ports 144*a*, 144*b* and the second set of ports 146*a*, 146*b*. In a preferred embodiment, the valve piston 148 may be cylindrical in shape. The valve piston 148 may further include an annular groove 150 along its periphery. The annular groove may connect the inlet 142 with the first set of ports 144*a*, 144*b*. Further, the annular groove 150 may facilitate the flow of air from the inlet 142 to each port of the first set of ports 144*a*, 144*b*. It will be apparent to a person skilled that the annular groove 150 may get in-line with each of the ports 144*a*, 144*b* during the reciprocating movement of the valve piston 148, and accordingly deliver air to each of the ports 144*a*, 144*b*.

Herein an explanation about the working of the valve piston 148 in relation to the first set of ports 144*a*, 144*b* and the second set of ports 146*a*, 146*b* is provided. When the annular groove 150 of the valve piston 148 may get in-line with the port 144*a*, the compressed air may flow via the annular groove 150 to the port 144*a*, and into the air chamber 132*a*. At the same time, the air in the air chamber 132*b* may flow into the valve housing 138 via the port 144*b*, and out into the atmosphere via the port 146*b*. The air may flow from the port 144*b* to the port 146*b* via a path 178*b* provided on the valve piston 148.

Further, when the valve piston 148 moves to the other end, the annular groove 150 may get in-line with the port 144*b*. At this point, the compressed air may flow via the annular groove 150 to the ports 144*b* and into the air chamber 132*b*. When the air is getting filled in the air chamber 132*b*, the air in the air chamber 132*a* may flow into the valve housing 138 via the port 144*a*, and out into the atmosphere via the port 146*a*. The air may flow from the port 144*a* to the port 146*a* via a path 178*a* provided on the valve piston 148.

The valve piston 148 may further include a bore 152 at one end. The bore 152 may be machined into the one end of the valve piston 148. In an embodiment, the bore 152 may be a cylindrical bore. The valve piston may further include a secondary bore 154*a*, 154*b* at each end of the valve piston 148. For the purpose of explanation, the diameter of the secondary bores 154*a*, 154*b* may be smaller than the diameter of the bore 152.

The actuator valve 136 may further include an end plate 156*a*, 156*b* arranged at each end of the valve housing 138. The end plates 156*a*, 156*b* may be provided to limit the movement of the valve piston 148 within the valve housing 138. Further, both the end plates 156*a*, 156*b* may have a groove 172*a*, 172*b* along its periphery. The groove 172*a*, 172*b* of both the end plates 156*a*, 156*b* may accommodate a respective O-ring 174*a*, 174*b*. The O-ring 174*a*, 174*b* may be provided to seal the space between both the end plates 156*a*, 156*b* from the atmosphere. One of the end plates 156*a* may have a boss 158. For the purpose of explanation, the boss 158 may be a shaft protruding from one of the end plates 156*a*. The boss 158 may be provided on the end plate 156*a* which is arranged at the corresponding end of the valve piston 148 with the bore 152. Further, the arrangement of the boss 158 and the bore 152 may be such that the boss 158 may mate with the bore 152. Moreover, the boss 158 and the bore 152 may form a pressure tight seal while mating. The pressure tight seal may be achieved via a sealing member 160 that is accommodated in a circular groove 162 provided at the distal end of the boss 158. In an embodiment, the sealing member 160 may be an O-ring.

It should be noted that due to the boss 158 and the bore 152 arrangement in the actuator valve 136, the surface area on one side of the valve piston 148 may be lesser in comparison to the other side of the valve piston 148. For the purpose of explanation, the surface area on the side of the valve piston 148 with the boss 158 and the bore 152 may be lesser than the other side of the valve piston without the boss 158 and the bore 152. Due to the unequal surface area on both sides of the valve piston 148, the valve piston 148 may not get centered, and instead will move in the direction of the end plate 156*a* with the boss 158. In this way, the actuator valve 136 may prevent stalling of the valve piston 148.

One of the end plates 156*b* may further include a pin 164. The pin 164 may be positioned so as to engage the secondary bore 154*b* of the valve piston 148. The pin 164 and the secondary bore 156*a*, 156*b* at each end of the valve piston may be provided to pressurize the space between each end of the valve piston 148 and the respective end plates 156*a*, 156*b*. Moreover, this arrangement may also prevent the rotary motion of the valve piston 148. The actuator valve 136 may further include a circlip 166*a*, 166*b* arranged at each end of the valve housing 138. The circlips 166*a*, 166*b* may act as end stops to the end plates 156*a*, 156*b*. The circlips 166*a*, 166*b* may be arranged in the valve housing 138 in a such a way that the circlip 166*a* may act as an end stop for the end plate 156*a*, and the circlip 166*b* may act as end stop for the end plate 156*b*. Each of the circlips 166*a*, 166*b* may be accommodated in a groove provided on the internal surface of the valve housing 138.

Referring now to FIG. 8, a side view of the actuator valve 136 is illustrated in accordance with an exemplary embodiment of the present invention. The actuator valve 136 may further include a key and slot arrangement for restricting the rotary motion of the valve piston 148. In the key and slot arrangement, a slot 168 may be provided on the valve housing 138. Further, a key 170 may be provided on the valve piston 148 that engages with the slot 168 thereby restricting the rotation of the valve piston 148.

Various modifications to these embodiments are apparent to those skilled in the art from the description and the accompanying drawings. The principles associated with the various embodiments described herein may be applied to other embodiments. Therefore, the description is not intended to be limited to the embodiments shown along with the accompanying drawings but is to be providing broadest scope of consistent with the principles and the novel and inventive features disclosed or suggested herein. Accordingly, the invention is anticipated to hold on to all other such alternatives, modifications, and variations that fall within the scope of the present invention and appended claims.

What is claimed is:

1. An actuator valve (136) of an air operated double diaphragm pump (100), the air operated double diaphragm pump having two chambers (112*a*, 112*b*), and a central shaft (124) disposed between the two chambers (112*a*, 112*b*), the central shaft (124) having a diaphragm (130*a*, 130*b*) at each end, the diaphragm (130*a*, 130*b*) at each end divides the respective chamber (112*a*, 112*b*) into an air chamber (132*a*, 132*b*) and a fluid chamber (134*a*, 134*b*), the actuator valve (136) comprising: a valve housing (138), an inlet (142) for receiving air from an external source; a first set of ports (144*a*, 144*b*) for exchanging the air with each of the air chambers (132*a*, 132*b*); a second set of ports (146*a*, 146*b*) for exhausting the air received from each of the air chambers (132*a*, 132*b*) into the atmosphere; a valve piston (148) accommodated within the valve housing (138), the valve piston (148) is configured to reciprocally slide within the valve housing (138); and an end plate (156*a*, 156*b*) arranged at each end of the valve housing 138 for limiting the movement of the valve piston (148), wherein the valve piston (148) has a bore (152) at one end and the valve piston (148) further comprises a secondary bore (154*a*, 154*b*) at each end in order to pressurize a space between each end of the valve piston (148) and the respective end plates (156*a*, 156*b*), to prevent stalling of the valve piston (148) and rotary motion of the valve piston (148), wherein the end plate (156*a*) has a boss (158) at the corresponding end, wherein the boss (158) of the end plate (156*a*) is arranged to mate with the bore (152) of the valve piston (148), and the boss (152) of the end plate (156*a*) and the bore (152) of the valve piston (148) form a pressure tight seal while mating, wherein the boss (158) has a circular groove (162) at the distal end, and wherein a sealing member (160) is accommodated within the circular groove (162) and the sealing member (160) is an O-ring.

2. The actuator valve (136) as claimed in claim 1, wherein the air received from the external source is a compressed air.

3. The actuator valve (136) as claimed in claim 1, wherein the first set of ports (144*a*, 144*b*) includes at least two ports and, wherein each of the two ports is configured to exchange air with the respective air chamber (132*a*, 132*b*).

4. The actuator valve (136) as claimed in claim 1, wherein the second set of ports (146*a*, 146*b*) includes at least two ports and, wherein each of the two ports is configured to exhaust the air received from the respective air chamber (132*a*, 132*b*) into the atmosphere.

5. The actuator valve (136) as claimed in claim 1, wherein the valve piston (148) further comprises an annular groove (150) for allowing the air to flow from the inlet (142) to the first set of ports (144*a*, 144*b*).

6. The actuator valve (136) as claimed in claim 1, wherein one of the end plates (156*b*) has a pin (164) for engaging the corresponding secondary bore (154*b*) of the valve piston (148).

7. An air operated double diaphragm pump (100) comprising: an inlet manifold (102) having an inlet port (104), the inlet manifold (102) is configured to receive a fluid via the inlet port (104); an outlet manifold (106) having an outlet port (108), the outlet manifold (106) is configured to exhaust the fluid via the outlet port (108); two chambers (112*a*, 112*b*); a central shaft (124) disposed between the two chambers (112*a*, 112*b*), the central shaft (124) is configured to reciprocate between the two chambers (112*a*, 112*b*); a diaphragm (130*a*, 130*b*) attached at each end of the central shaft (124), the diaphragm (130*a*, 130*b*) at each end is configured to divide the respective chamber (112*a*, 112*b*) into an air chamber (132*a*, 132) and a fluid chamber (134*a*, 134*b*); an actuator valve (136), the actuator valve (136) comprising: a valve housing (138); an inlet (142) for receiving air from an external source; a first set of ports (144*a*, 144*b*) for exchanging the air with each of the air chambers (132*a*, 132*b*); a second set of ports (146*a*, 146*b*) for exhausting the air received from each of the air chambers (132*a*, 132*b*) into the atmosphere; a valve piston (148) accommodated within the valve housing (148), the valve piston (148) is configured to reciprocally slide within the valve housing (138); and an end plate (156*a*, 156*b*) arranged at each end of the valve housing (138) for limiting the movement of the valve piston (148), wherein the valve piston (148) has a bore (152) at one end, and the valve piston (148) further comprises a secondary bore (154*a*, 154*b*) at each end in order to pressurize a space between each end of the valve piston (148) and the respective end plates (156*a*, 156*b*), to prevent stalling of the valve piston (148) and rotary motion of the valve piston (148), wherein the end plate (156*a*) has a boss (158) at the corresponding end, and wherein the boss (158) of the end plate (156*a*) is arranged to mate with the bore (152) of the valve piston (148), and the boss (152) of the end plate (156*a*) and the bore (152) of the valve piston (148) form a pressure tight seal while mating, wherein the boss (158) has a circular groove (162) at the distal end, and wherein a sealing member (160) is accommodated within the circular groove (162) and the sealing member (160) is an O-ring.

* * * * *